United States Patent [19]

Raasch

[11] 4,222,224

[45] Sep. 16, 1980

[54] DEVICE FOR TEMPORARILY STOPPING THE OPERATION OF SPINNING STATIONS

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 742,197

[22] Filed: Nov. 16, 1976

[30] Foreign Application Priority Data

Nov. 22, 1975 [DE] Fed. Rep. of Germany ..... 2552448

[51] Int. Cl.[2] ..... D01H 15/00; D01H 11/00; D01H 13/14; D01H 13/24

[52] U.S. Cl. ..... 57/263; 57/301; 57/302; 57/81

[58] Field of Search ..... 57/58.89–58.95, 57/78–81, 83, 261, 301, 263, 302, 264

[56] References Cited

U.S. PATENT DOCUMENTS

| | | | |
|---|---|---|---|
| 3,608,293 | 9/1971 | Brouwer | 57/261 X |
| 3,810,352 | 5/1974 | Miyazaki et al. | 57/263 |
| 3,858,385 | 1/1975 | Shinkai et al. | 57/263 |
| 3,950,926 | 4/1976 | Stahlecker | 57/263 |
| 4,043,106 | 8/1977 | Stahlecker | 57/263 |

*Primary Examiner*—Donald Watkins
*Attorney, Agent, or Firm*—Herbert L. Lerner

[57] ABSTRACT

Device for temporarily stopping the operation of spinning stations of a spinning machine equipped with means for automatic inspection and/or cleaning of the machine after an interruption in the spinning operation at a spinning station and for thereafter restarting the operation of the respective spinning station includes a monitoring device associated with each spinning station having means for producing an intentional interruption of the spinning operation at the respective spinning station when a given value of a characteristic of the uninterrupted spinning process is reached or exceeded and only when no other spinning station serviced by the means for automatic inspection and/or cleaning of the machine is out of operation due to an interruption of the spinning operation performed thereat that requires correction.

3 Claims, 3 Drawing Figures

DEVICE FOR TEMPORARILY STOPPING THE OPERATION OF SPINNING STATIONS

The invention relates to a device for temporarily stopping the operation of spinning stations of a spinning machine, particularly a rotary spinning machine which is equipped with devices for automatic inspection and/or cleaning of the machine after an interruption of the spinning operation and subsequent restarting of the operation of the respective spinning station.

It has been known heretofore that, with increasing running time of the spinning station of a rotary spinning machine without any thread break, the rotor becomes dirty and, thereby, a yarn of poorer quality is spun. The decline in the yarn quality manifests itself in decreasing uniformity and reduced elongation of the yarn. In addition, the danger is increased that periodic variations in the uniformity of the yarn cross section occur, which can lead to undesirable moiree effects later when weaving a fabric.

To keep such fouling or soiling within limits, it has already been proposed heretofore to stop and clean the spinning machine from time to time. This cleaning is preferably carried out by an automatically operating device for inspection and machine cleaning. After the inspection or cleaning of the machine, the same device can restart the operation of the spinning stations one after the other.

Since yarn defects also occur, however, which are not caused by the fouling or soiling of the rotor, the spinning machines are equipped with so-called yarn cleaners which monitor the yarn thickness continuously and interrupt the spinning process if a set value is exceeded. After such an interruption an inspection and/or machine cleaning by the automatically operating device also follows, and thereafter, restarting of the operation of the spinning station. Individual spinning stations are switched off and cleaned less often and others again more often. If the spinning machine is now turned off in accordance with the cycle, those spinning stations in which an inspection or cleaning had taken place just before are also inspected and cleaned anew. This basically unnecessary repeated inspection and machine cleaning can cause considerable losses in efficiency.

It is accordingly an object of the invention to provide a device of the foregoing type which avoids the aforementioned disadvantages of the heretofore known devices of this general type.

With the foregoing and other objects in view, there is provided, in accordance with the invention, a device for temporarily stopping the operation of spinning stations of a spinning machine equipped with means for automatic inspection and/or cleaning of the machine after an interruption in the spinning operation at a spinning station and for thereafter restarting the operation of the respective spinning station including a monitoring device associated with each spinning station having means for producing an intentional interruption of the spinning operation at the respective spinning station when a given value of a characteristic of the uninterrupted spinning process is reached or exceeded and only when no other spinning station serviced by the means for automatic inspection and/or cleaning of the machine is out of operation due to an interruption of the spinning operation performed thereat that requires correction.

Thus, the entire spinning machine is no longer turned off in accordance with the cycle, but a selection is made depending upon the magnitude of a characteristic of the uninterrupted spinning operation e.g. the running time without a thread break of the individual spinning station. An added criterion is that an intentional interruption of the spinning operation takes place only when there is an actual possibility of an early cleaning or inspection. Otherwise, the spinning station remains in operation in the interim.

Advantageously, the magnitude of the characteristic of the uninterrupted spinning operation is predetermined individually for each spinning station. According to a further feature of the invention, there is associated with each spinning station a counter which is controlled by a clock and delivers a switching-off pulse to the spinning station when a fixed number of counted timing pulses is reached or exceeded. The counter can, for example, begin to count whenever the spinning station is placed in operation and be set to zero automatically upon every thread break.

If no other thread break occurs, the operation of the spinning station is stopped for inspection and/or machine cleaning at the intervals which are determined to be desirable.

Such monitoring devices may be disposed at the spinning station itself, physically separated from the spinning station or also centrally located.

It is sensible and effective to stop the operation of the spinning stations one after the other even if, in an individual case, the magnitude of the characteristic of the uninterrupted spinning operation which is predetermined as a desirable maximum is more-or-less widely exceeded. The predetermined interval, at the end of which the spinning station is to be turned off for inspection and/or machine cleaning, is set or adjusted at the counter.

According to another feature of the invention, the magnitude of the characteristic of the uninterrupted spinning operation can be set or adjusted, for example, at equal time intervals for a multiplicity of spinning stations simultaneously, the spinning operation being intentionally interrupted at the end of the interval only at those spinning stations which had no unintentional thread break during the interval. For this purpose, in accordance with the invention, the device of the invention includes a timing pulse generator associated with the spinning machine for issuing to the spinning stations a pulse to switch-off the respective spinning stations after a given time interval, a switch-off interlocking device associated with each of the spinning stations and being responsive to an unintentional interruption of the spinning operation at the respective spinning station during the given time interval, the switch-off interlocking device cooperating with the timing pulse generator for transmitting the switch-off pulse to the respective spinning station only when no unintentional interruption of the spinning operation at the respective spinning station has occurred during the given time interval.

With each spinning station, there may be associated, for example, a storage or storage place which is set if a thread break occurs during the time interval and is cleared by the switch-off pulse of the timing pulse generator. With the storage set, the switch-off interlocking device must then be effective.

In accordance with an added feature of the invention, there is included an interlocking device for blocking intentional interruption at the spinning operation at a respective spinning station when the given value of a characteristic of the uninterrupted spinning process performed thereat is reached or exceeded, the blocking being for a period as long as another spinning station of the group of spinning stations serviced by the means for automatic inspection and/or cleaning of the machine after an interruption in the spinning operation is out of operation due to an interruption of the spinning operation performed thereat that requires correction. Electronic components are particularly well suited for use in such an interlocking device.

In accordance with an additional feature of the invention, the means for automatic inspection and/or cleaning of the machine after an interruption in the spinning operation at a spinning station is actuatable for traveling between several of the spinning stations for servicing the spinning stations in a successive time sequence, and an interlocking device is included for blocking intentional interruption of the spinning operation at a respective spinning station when the given value of a characteristic of the uninterrupted spinning process performed thereat is reached or exceeded, said blocking being for a period until said means for automatic inspection and/or cleaning of the machine is in vicinity of the respective spinning station.

The means for automatic inspection and/or machine cleaning which travels past the spinning stations in accordance with the cycle may act upon the aforementioned interlocking device, for example, through a proximity switch and unlock it upon approaching.

Advantages attained with the device of the invention are especially that, while maintaining high efficiency, machine cleaning or inspection can be performed in the spinning machine at predetermined time intevals that are not too long nor too short, even if an unintentional interruption of the spinning operation e.g. a thread break, has occurred in the interim at a spinning station or several spinning stations and, in the course of correcting this interruption, an inspection or cleaning of the machine has taken place.

By means of the device of the invention, down times are further reduced and are limited only to an amount that is absolutely necessary.

Other features which are considered as characteristic for the invention are set forth in the appended claims.

Although the invention is illustrated and described herein as embodied in a device for temporarily stopping the operation of spinning stations, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
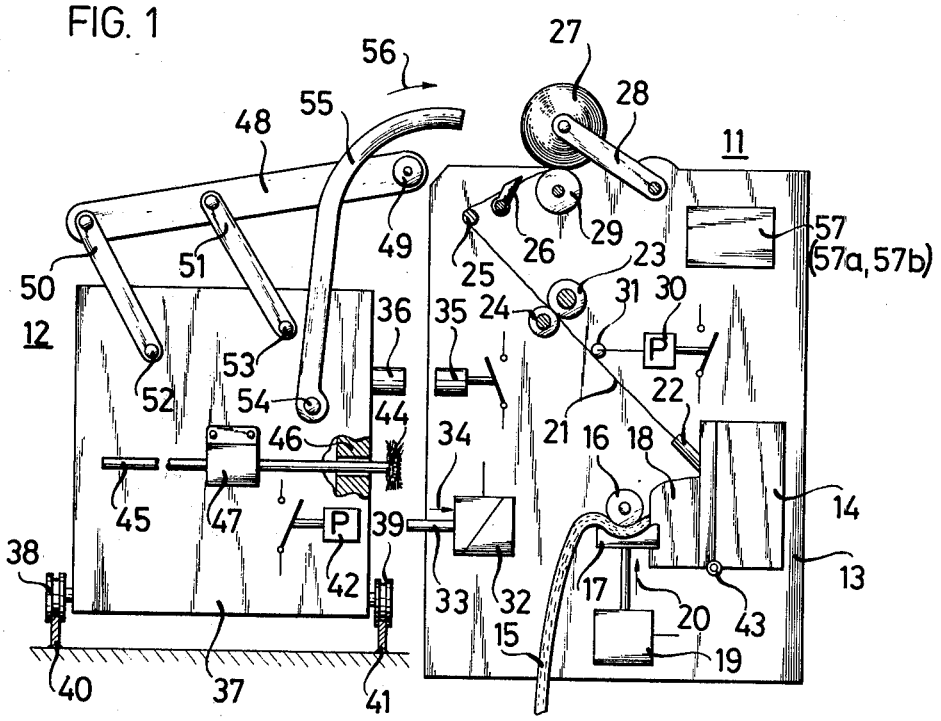
FIG. 1 is a diagrammatic side elevational view of an individual spinning station of a rotary spinning machine with an associated device for automatic machine-cleaning and subsequent restarting of the operation of the spinning station.

Referring now to the drawing and first, particularly, to FIG. 1 thereof, there is shown a spinning station 11 and a device 12 for automatic machine-cleaning and subsequent restarting of the operation of the spinning station.

The spinning station 11 has a machine frame 13, to which a spinning box 14 is fastened. A sliver 15 is advanced by a drawing-in cylinder 16 by means of a clamping table 17 into a fiber loosening device built into the cover 18 of the spinning box 14. The clamping table 17 can be moved away or lifted from the drawing-in cylinder 16 by an electromagnetic drive or actuator 19 (the fall-back restoring direction of which is indicated by an arrow 20), whereby the feeding of the sliver is interrupted. Spun thread 21 leaves the spinning box 14 through a withdrawal tube 22. The spun thread 21 is drawn out of the spinning box 14 by withdrawal cylinders 23 and 24 at constant velocity, is led over a thread deflection wire 25 and wound on a coil 27 in cross-wound layers by means of a reciprocating thread guide 26; the coil 27 is held by a pendulously suspended coil holder 28 and rolls on a winding cylinder 29. The winding cylinder 29 rotates continuously and drives the coil 27 by friction.

By means of a thread monitor switch 30 having a sensing roller 31 which rests on the tensioned thread 21, the operation of the spinning station 22 can be stopped the instant a thread break occurs. In the event of a thread break, the thread monitor switch 30 causes, among other things, an electromagnetic drive or actuator 32 to be switched on. The electromagnetic actuator 32 has a plunger 33, the fall-back or restoring direction of which is indicated by an arrow 34. After a thread break, the plunger 33 is therefore driven in a direction opposite to that indicated by the arrow 34.

The spinning station 11 has, in addition, a proximity switch 35 which can be influenced or controlled by a projection 36 attached to the housing 37 of the device 12.

The device 12 for automatic machine-cleaning can be moved along the front side of the spinning machine by means of rollers 38 and 39 on tracks 40 and 41. In the ready position, the device 12 runs back and forth in a fixed cycle past an associated multiplicity of spinning stations of the spinning machine. If the plunger 33 is driven out at a spinning station due to a thread break, this plunger 33 switches-on the switch 42 which is located on the device 12 and, through the closing of which by suitable conventional means, the device 12 comes to a standstill at the respective spinning station, performs the cleaning of the machine and subsequently restarts the operation of the spinning station. After the cover 18, which is pivoted on a hinge 43, is opened, a rotating cleaning brush 44 is then driven into the rotor of the spinning station. The cleaning brush 44 is mounted at the end of a shaft 45 which is guided in the bearing 46 and is rotated by a brush drive 47.

After the rotor is cleaned, the cleaning brush 44 is withdrawn to the starting position thereof, and the cover 18 closed. Then, a reversing roll 49, which is attached to a rod 48, is pushed between the winding cylinder 29 and the coil 27 and the latter is thereby set in reverse rotation. The advance or feed of the rod 48 is cared for by two levers 50 and 51 which are articulatingly linked to the rod 48. The levers 50 and 51 are fastened to shafts 52 and 53, which are supported rotatably in the housing 37. Then, a suction nozzle 55 pivotally connected at the point 54 is swung in direction of the arrow 56 toward the surface of the coil 27. The suction nozzle 55 grips the thread end, passes it to a non-illustrated joining device, which places the gripped thread into the thread guide 26, leads it around the thread deflection wire 25, places it between the withdrawal rolls 23 and 24, introduces the thread end into the withdrawal tube 22 and sets the spinning station in operation. Prior to this, the rod 48 has been withdrawn, so that the coil 27 again rests directly on the winding cylinder 29. After the thread is joined and the coil 27 has started to turn in the winding direction, the thread is tensioned again and the thread monitor switch 30 is switched off.

The circuit and operation of the electromagnetic drives or actuators 19 and 32 and of the switches 30 and 35 will be explained in detail hereinafter with the aid of two embodiments of the invention shown schematically in FIGS. 2 and 3 of the drawings.

Figure 2:
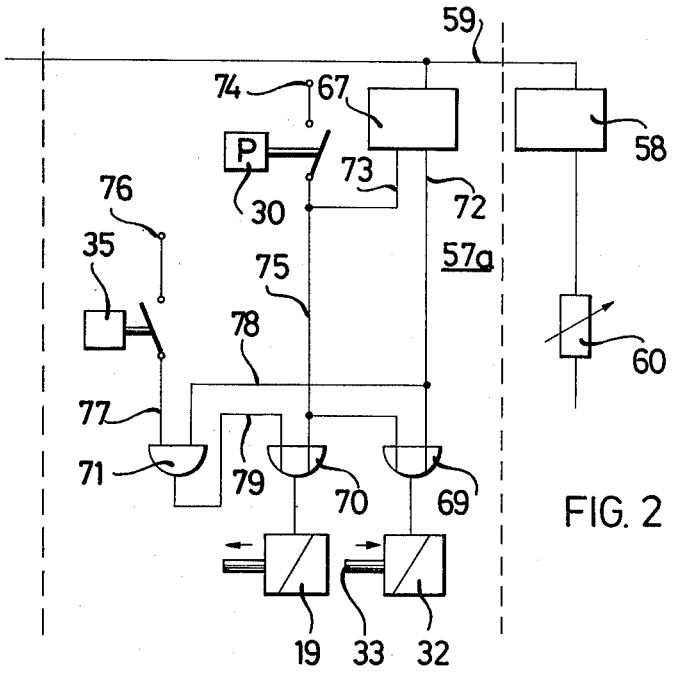
FIGS. 2 and 3 are electric circuit digrams of different embodiments of the device according to the invention.

In the first embodiment, a clock generator 58 is shown in FIG. 2, which sends timing pulses into the line 59. The frequency of the pulses can be adjusted at the potentiometer 60. The monitoring device proper, 57*a*, which is associated with each spinning station, is formed of a counter 67, two OR gates 69 and 70 and an AND gate 71. At the counter 67, that number of input pulses is set which, when reached, is to make a 1-signal appear at the output 72. If a 1-signal is present at the input 73, the counter 67 is reset to zero. If, during the running time of the counter 67, an unintended thread break occurs, the thread monitor switch 30 is closed and the magnetic actuators 19 and 32 (see also FIG. 1) are switched-on by the voltage source 74 through the line 75 and the OR gates 69 or 70, respectively. The plunger 33, which is then driven out, acts on the switch 42 of the movable device 12 shown in FIG. 1. The switch 42 is closed, whereby the stopping of the movable device 12 at the respective spinning station, the machine cleaning and the subsequent restarting of the operation of the spinning station are initiated. The projection 36 of the device 12 acts upon the proximity switch 35 of the spinning station 11 beforehand as the device 12 approaches, so that the proximity switch 35 closes, whereby a 1-signal from a voltage source 76 reaches the input 77 of the AND gate 71. Since the other input of the AND gate 71 receives no 1-signal through the line 78, the actuation of the switch 36 has at first no further effect. Since the line 75 is also connected to the counter input 73, the counter 67 is at the same time reset to zero because the thread monitor switch 30 is closed.

After the thread break is repaired, the counter 67 starts anew. If then no unintended thread break occurs during the following programmed running time of the counter 67, the output 72 receives a 1-signal when the predetermined running time is reached. The electromagnetic actuator 32 is then switched on through the OR gate 69, and the one input of the AND gate 71 receives a 1-signal through the line 78. As the device 12 approaches, the proximity switch 35 is closed, whereby also the second AND condition is fulfilled in the AND gate 71. The output of the AND gate 71 is connected through a line 79 to the one input of the OR gate 70, so that then also the electromagnetic actuator 19 is switched on, which results in an intentional thread break (see also FIG. 1), so that the thread monitoring switch 30 is closed. The line 75 then carries voltage, which causes the counter 67 to be reset to zero. Although the output 72 of the counter 67 carries an 0-signal, the electromagnetic actuators 19 and 32 remain switched on through the line 75 and the OR gates 69 and 70. Only after the then existing, intentional thread break is repaired i.e. after the thread is joined and the spinning station is back in operation, is the thread monitor switch 30 opened again, whereby the electromagnetic actuators 19 and 32 are switched off and the counter 67 starts counting.

In this first embodiment of the invention, the spinning station continues to run, if stopping is to take place only for the purpose of cleaning the machine, until the device 12 which is to perform the cleaning, has approached. It can always approach only if it is ready for operating, having completed its previous activity.

Figure 3:
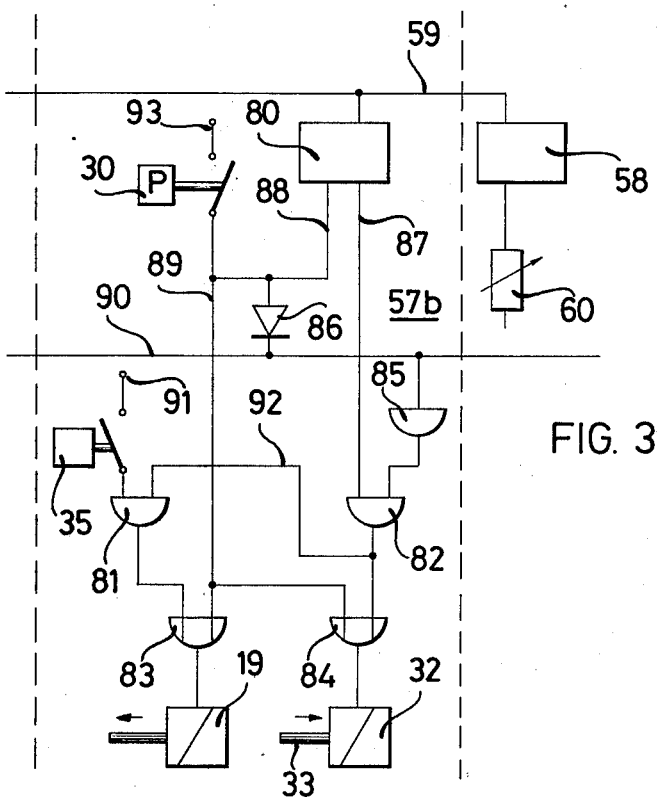

In the second embodiment of the invention as shown schematically in FIG. 3, the clock generator 58 cooperating with all the spinning stations, the potentiometer 60 and the line 59 are provided. The monitoring device 57*b* for the uninterrupted spinning operation associated with each spinning station consists in this second embodiment of the counter 80, the AND gates 81 and 82, the OR gates 83 and 84, a NOT gate 85 and a diode 86. In this case too, the number of input pulses which, when reached or exceeded, calls for a 1-signal to appear at the counter output 87, is set at the counter 80. The counter is set to zero by a 1-signal applied to the counter input 88.

If, during the running time of the counter 80, an unintended thread break occurs, the thread monitor switch 30 closes and the magnetic actuators 19 and 32 are switched on through the line 89 and the OR gates 83 and 84. As in the first embodiment, the switch 35 closes only upon the approach of the device 12 which, however, has at first no effect on the other elements of the circuit. Since the line 89 is also connected to the input 88 of the counter 80, the counter is reset to zero. The line 89 simultaneously has a connection with the diode 86 also in the forward direction, so that a 1-signal is present on the bus 90 when the thread monitor switch 30 closes. Since the bus 90 is connected to the diodes of the monitoring devices of the other spinning stations, in the same manner, a 1-signal appearing on the bus 90 may come from any spinning station. The bus 90 is connected to the input of the NOT gate 85, the output of which leads to the input of the AND gate 82. As soon as a 1-signal is present on the bus 90, the AND condition can no longer be fulfilled at the AND gate 82. The switch 30, the diode 86 and the NOT gate 85 together form an interlocking device.

After the thread break is repaired by the device 12, the counter 80 starts anew. If then no unintended thread break occurs during the following programmed running time of the counter, the output has a 1-signal when the end of the predetermined running time is reached. If then a 0-signal is present on the bus, the AND condition is fulfilled at the AND gate 82, so that the electromagnetic actuator 32 is switched on through the following OR gate 84. If, however, the thread monitor switch has responded at any other spinning station, a 1-signal is present on the bus 90 and the AND condition at the AND gate 84 cannot be fulfilled. In that case, the magnetic actuator 32 is switched on only if the thread monitor switch is opened again at the disrupted other spinning station i.e. if the device 12 has repaired the thread break there.

When the electromagnetic actuator 32 is switched on, the electromagnetic actuator 19 is not also switched on at the same time. First, the proximity switch 35 must be closed, which occurs only when the device 12 approaches. A connection is then established from the voltage source 91 through the switch 35 to the one input of the AND gate 81. Since, from the output of the AND gate 82, a 1-signal is already present at the second input of the AND gate 81 through the line 92, the AND condition is fulfilled and the electromagnetic actuator 19 is switched on through the OR gate 83. An interlocking device is thus formed by the diode 86, the bus 90 and the NOT gate 85. This results in the immediate interruption of the feeding of the sliver, which causes a thread break by which the thread monitor switch 30 is automatically closed. At the same instant, the OR gates 83 and 84 receive a 1-signal from the voltage source 93 while the counter 80 is reset to zero through the input 88. The switching condition of the ready position shown in FIG. 1 is reached again only if the device has performed the cleaning of the machine and has restarted the operation of the spinning station.

Equally applicable to both embodiments, is that an identical monitoring device is associated with each spinning station of a machine section served by one and the same device for automatic machine-cleaning and subsequent restarting of the operation of the spinning station.

If, due to the construction, the 1-signal appears at the counter outputs of the monitoring devices only for a short time when the predetermined count is reached and does not remain until the counter is reset, a storage device can be connected to each counter output and can be set when the 1-signal appears and cleared when the counter is set to zero.

As noted hereinbefore, the invention is not limited to the embodiments shown and described. Other embodiments are also possible within the scope of the claims and the other statements herein regarding the invention.

The monitoring devices or parts thereof need not necessarily be disposed at the spinning stations. They may also be combined, for example, in a central installation and assigned, in accordance with the invention, to the individual spinning stations. The central installation may be, for example, a data processing installation which can also serve other purposes.

There are claimed:

1. Spinning machine, comprising a plurality of open-end spinning units and a movable servicing apparatus for servicing any of said spinning units; said servicing apparatus having associated therewith: means for servicing a spinning unit at which said servicing apparatus is stopped, and means for re-starting the spinning operation after servicing has been carried out; each spinning unit having associated therewith: means for interrupting the spinning operation, means for stopping said servicing apparatus at a spinning unit, means for sensing the arrival of said servicing apparatus at a spinning unit, monitoring means for determining when a preselected stage in the uninterrupted spinning operation at any spinning unit has been reached or exceeded and when said stage has been reached or exceeded and said sensing means has sensed the arrival of said servicing apparatus at said unit, for subsequently causing said stopping means to stop said servicing apparatus at said unit, for causing said interrupting means to interrupt the spinning operation at said unit, for causing said servicing means to service said unit, and for causing said re-starting means to re-start the spinning operation at said unit, means for detecting an unintentional thread breakage at any spinning unit and when a breakage has occurred, for immediately causing said interrupting means to interrupt the spinning operation at said unit, for subsequently causing said stopping means to stop said servicing apparatus at said unit, for causing said servicing means to service said unit, and for causing said re-starting means to re-start the spinning operation, and means associated with each spinning unit for deactivating said means for stopping said servicing apparatus at every spinning unit at which said preselected stage has been reached or exceeded but no unintentional thread breakage has occurred, if an unintentional thread breakage has occurred at any other spinning unit, whereby said spinning unit with an unintentional thread breakage will be serviced before any spinning unit at which said preselected stage has been reached or exceeded.

2. Spinning machine according to claim 1 or 2, wherein said monitoring means includes a counter and a pulse generator which transmits pulses to said counter, when a preselected number of pulses are received, said counter transmits a signal to said interrupting means to interrupt the spinning operation after said sensing means has sensed the arrival of said servicing apparatus.

3. Spinning machine, comprising a plurality of open-end spinning units and a movable servicing apparatus for servicing any of said spinning units; said servicing apparatus having associated therewith: means for servicing a spinning unit at which said servicing apparatus is stopped, and means for re-starting the spinning operation after servicing has been carried out; each spinning unit having associated therewith: means for interrupting the spinning operation, means for stopping said servicing apparatus at a spinning unit, means for sensing the arrival of said servicing apparatus at a spinning unit, monitoring means for determining when a preselected stage in the uninterrupted spinning operation at any spinning unit has been reached or exceeded and when said stage has been reached or exceeded and said sensing means has sensed the arrival of said servicing apparatus at said unit, for subsequently causing said stopping means to stop said servicing apparatus at said unit, for causing said interrupting means to interrupt the spinning operation at said unit, for causing said servicing means to service said unit, and for causing said re-starting means to re-start the spinning operation at said unit, means for detecting an unintentional thread breakage at any spinning unit and when a breakage has occurred, for immediately causing said interrupting means to interrupt the spinning operation at said unit, for subsequently causing said stopping means to stop said servicing apparatus at said unit, for causing said servicing means to service said unit, and for causing said re-starting means to re-start the spinning operation, and means associated with each spinning unit for deactivating said interrupting means of the spinning unit at which said preselected stage has been reached or exceeded but no unintentional thread breakage has occurred, if a thread breakage has occurred at any other spinning unit, whereby said spinning unit with a thread breakage will be serviced before the spinning unit at which said preselected stage has been reached or exceeded.

* * * * *